United States Patent [19]

Sasako et al.

[11] Patent Number: 5,074,229

[45] Date of Patent: Dec. 24, 1991

[54] CONTROL SYSTEM FOR FRAME SHIFT IN EMBROIDERING MACHINE

[75] Inventors: Hidenori Sasako, Ohmiya; Michio Hisatake, Tsukui; Takeshi Kongo, Hachioji, all of Japan

[73] Assignee: Janome Sewing Machine Co., Ltd., Tokyo, Japan

[21] Appl. No.: 572,710

[22] Filed: Aug. 24, 1990

[30] Foreign Application Priority Data

Aug. 24, 1989 [JP] Japan ..... 1-216036

[51] Int. Cl.[5] ..... D05B 21/00; D05B 69/36

[52] U.S. Cl. ..... 112/121.12; 112/277

[58] Field of Search ..... 112/121.12, 103, 275, 112/121.11, 277

[56] References Cited

U.S. PATENT DOCUMENTS 4,506,612 3/1985 Yanagi ..... 112/121.12

4,754,721 7/1988 Skogward ..... 112/275

4,858,542 8/1989 Kato et al. ..... 112/121.12

*Primary Examiner*—Peter Nerbun

*Attorney, Agent, or Firm*—Dann, Dorfman, Herrell and Skillman

[57] ABSTRACT

An embroidery frame attached to an embroidering machine is shifted on a horizontal plane by means of a pair of pulse motors for changing relative position between a vertically reciprocating needle and a fabric supported within the embroidery frame. A phase sensor is arranged for continuously detecting a rotational phase of an upper drive shaft which governs a vertical position of the needle. The pulse motors are controlled such that a horizontal shift of the embroidery frame is prevented or discontinued in a particular circumstance for preventing breakage of the needle and/or damage of the fabric which would otherwise occur during the frame shift operation.

4 Claims, 12 Drawing Sheets

$N = Nu + Nf + Nd$
$Nr = Nu + Nf' + Nd$

CONTROL SYSTEM FOR FRAME SHIFT IN EMBROIDERING MACHINE

BACKGROUND OF THE INVENTION

1. Field of the Invention

This invention relates in general to an electronically controlled embroidering machine capable of producing a desired embroidery pattern on a fabric supported within an embroidery frame. This invention is particularly directed to a control system for shifting under control the embroidery frame in the embroidering machine of the aboveidentified type.

2. Description of the Prior Art

An electronically controlled embroidering machine includes, as known, a needle connected to an upper drive shaft to reciprocate in a vertical direction in synchronism with rotation of the upper drive shaft which is driven by a machine motor, an embroidery frame detachably supported to the machine housing and a loop-taker means cooperating with the needle to form a stitch on a fabric supported in a stretched condition within the embroidery frame. The embroidery frame is stepwise shiftable in two perpendicular directions (X- and Y-directions) by respective pulse motors so that a relative position between the needle and the fabric may be obtained as desired. Embroidery pattern data for a plurality of embroidery patterns will be stored in a memory and selectively read out for controllably driving the machine motor and the pulse motors to thereby produce a selected embroidery pattern on the fabric.

The embroidery frame is shifted while the machine motor is rotating to actually produce the selected embroidery pattern. The embroidery frame will also be activated during suspension of the machine motor, for example in the following operations:

1) Initial position determining operation in which the embroidery frame is shifted to a predetermined initial position relative to the needle once the embroidering machine is energized.

2) Manual shift operation in which the embroidery frame is shifted to a desired position relative to the needle for producing the selected embroidery pattern on the fabric in a desired area or region thereof.

3) Stitch area confirming operation in which, prior to the actual embroidering operation, the embroidery frame is shifted in response to the pattern control data of the selected embroidery pattern, with the machine motor being kept standstill, for the purpose of confirming that the selected embroidery pattern may surely be produced within an area of the fabric defined and coutoured by the embroidery frame. 4) Frame forward-/back operation in which, when it is found at a certain stitch point that the stitch has been produced out of order or deformed at a previous stitch point, the embroidery frame is shifted back to the said previous stitch point so that such imperfect stitch is repaired by re-embroidering (in the frame back operation), and after that the embroidery frame is returned to the certain stitch point for re-starting subsequent embroidering operation (in the frame forward operation).

The initial position determining operation should not be carried out when the needle penetrates the fabric. To cope with this, the conventional system is provided with a sensor means which detects the vertical needle position relative to the fabric. If the needle should be currently positioned in contact with the fabric, which is discriminated by the sensor as "shift-prohibited circumstance", the initial position determining operation will be preceded by some rotation of the machine motor to separate the needle above from the fabric.

However, it is to be noted in this connection that the embroidery frame has a peripheral edge which upstands higher than a level of the fabric stretched within the frame and overlying the needle plate. Even when the needle tip end is located above the fabric but below the top of the peripheral edge of the embroidery frame and the current horizontal position of the needle is not within an area defined by the embroidery frame, this could not be detected as the "shift prohibited circumstance" in the conventional system, with the result that no preceding operation for the machine motor rotation is carried out. If the initial position determining operation should be commenced in this particular circumstance, the peripheral edge of the embroidery frame would come into contact with the needle and/or the presser foot while shifting the embroidery frame, which may break the needle and result in mechanical troubles.

In the stitch area confirming operation, the operator will be desirous to lower the needle to a position just above the fabric for easier confirmation of the stitch area. This can be achieved by manually rotating to a certain degree a flywheel connected directly to the upper drive shaft. However, since the flywheel may be freely rotated even by slight touching, there has been a tendency that the flywheel is overrotated to cause the needle to penetrate the fabric while the embroidery frame is shifting in the stitch area confirming operation. This would result in breakage of the needle and fatal damage of the fabric.

SUMMARY OF THE INVENTION

It is therefore an object of this invention to provide a frame shift control system in an electronically controlled embroidery machine capable of eliminating disadvantages and defects found in actual operation of the conventional system.

According to an aspect of this invention there is provided a control system for controlling horizontal shift of an embroidery frame of an electronically controlled embroidering machine, comprising phase detect means for detecting rotational phase of an upper drive shaft of the embroidering machine, discriminating means for discriminating whether the embroidery frame is shiftable in response to a detection result from the phase detect means, stop means for causing immediate stop of pulse motors employed to shift the embroidering machine when the discriminating means discriminates that the embroidery frame is not shiftable, and re-starting means for re-starting the pulse motors when the discriminating means discriminates that the embroidery frame becomes shiftable after the embroidery frame has been stopped by the stop means.

BRIEF DESCRIPTION OF THE DRAWINGS

Further objects and advantages of this invention can be fully understood from the following detailed description when read in conjunction with the accompanying drawings in which.

DETAILED DESCRIPTION OF THE EMBODIMENT

Figure 12:
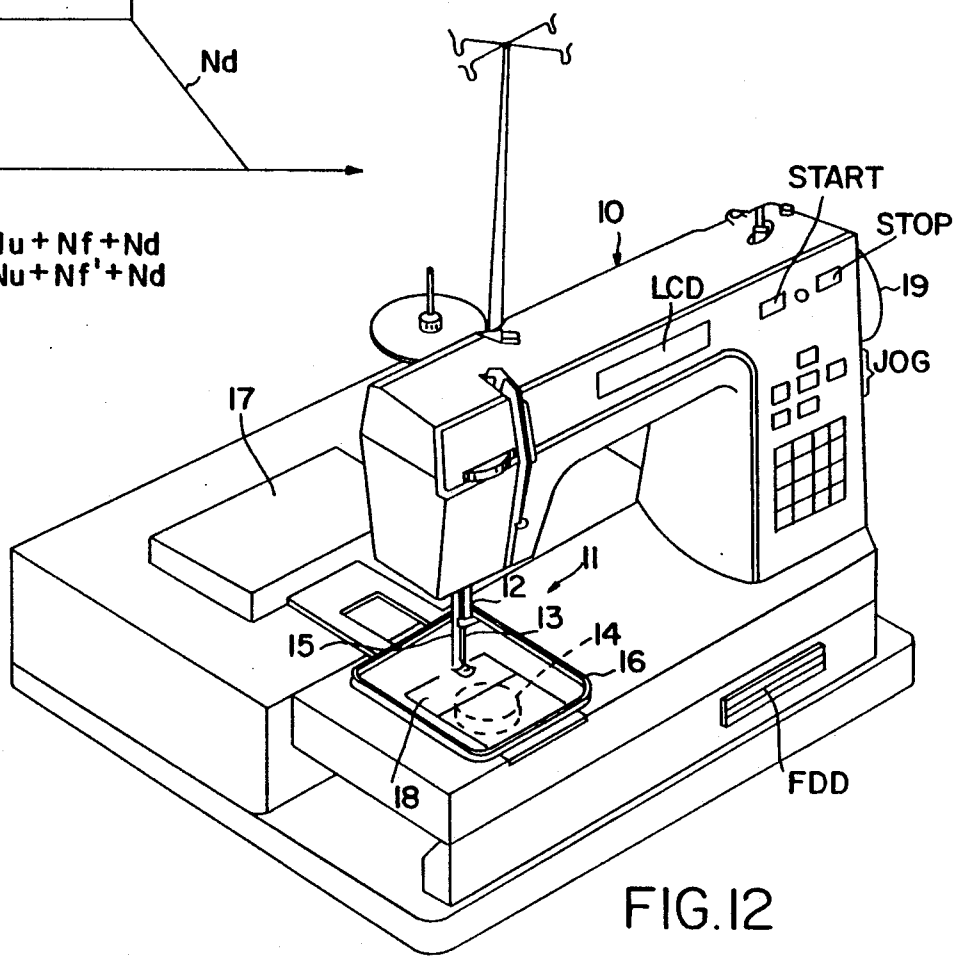
FIG. 12 is a perspective view of an electronically controlled embroidering machine into which the control system is incorporated.

Referring first to FIG. 12, in an electronically controlled embroidering machine 10 into which a control system of the present invention is incorporated, there is a stitch forming instrument 11 including a needle 13 attached to a lower end of a needle bar 12 driven by a machine motor ZM (FIG. 13) to reciprocate in a vertical direction, and a loop-taker means 14 cooperating with the needle 13 so that a thread loop formed around the needle 13 is taken thereby to form a stitch on a workpiece or fabric (not shown). A presser foot 15 is provided for exerting a downward pressure onto the fabric during the stitch forming operation. A needle plate 18 is located between the needle 13 and the loop-taker means 14 and includes a hole (not shown) for allowing penetration of the needle 13.

The fabric is supported in a stretched condition within an embroidery frame 16 detachably mounted to a supporting member 17. The supporting member 17 is connected to a drive mechanism (not shown) which is, in turn, driven under control by a pair of pulse motors XM and YM (FIG. 13) via transmission means such as pulleys and wires (not shown) to move in two perpendicular directions X and Y. With this arrangement, the embroidery frame 16 may be shifted as desired in the X and/or Y directions to designate a stitch point on the fabric which is located in vertical alignment with the needle 13. Thus, a selected embroidery pattern may be formed on the fabric in response to the embroidery pattern data peculiar thereto in a known manner. There are prepared in advance a plurality of embroidery frames having different sizes and contours, one of which may be selected and actually attached to the supporting member 17 upon demand.

There is provided a flywheel 19 connected directly to an upper drive shaft (not shown), rotation of which is duly transmitted to the needle 13. The flywheel 19 may be manually rotated to cause compulsory rotation of the upper drive shaft even when the latter is not being driven by the machine motor ZM.

On a front upright portion of the machine housing, there are arranged a plurality of control or command keys including a start key START, a stop key STOP and frame shift keys JOG. There are also provided a display LCD on a neck portion of the machine housing. A floppy disc drive FDD is installed at the bottom.

Figure 13:
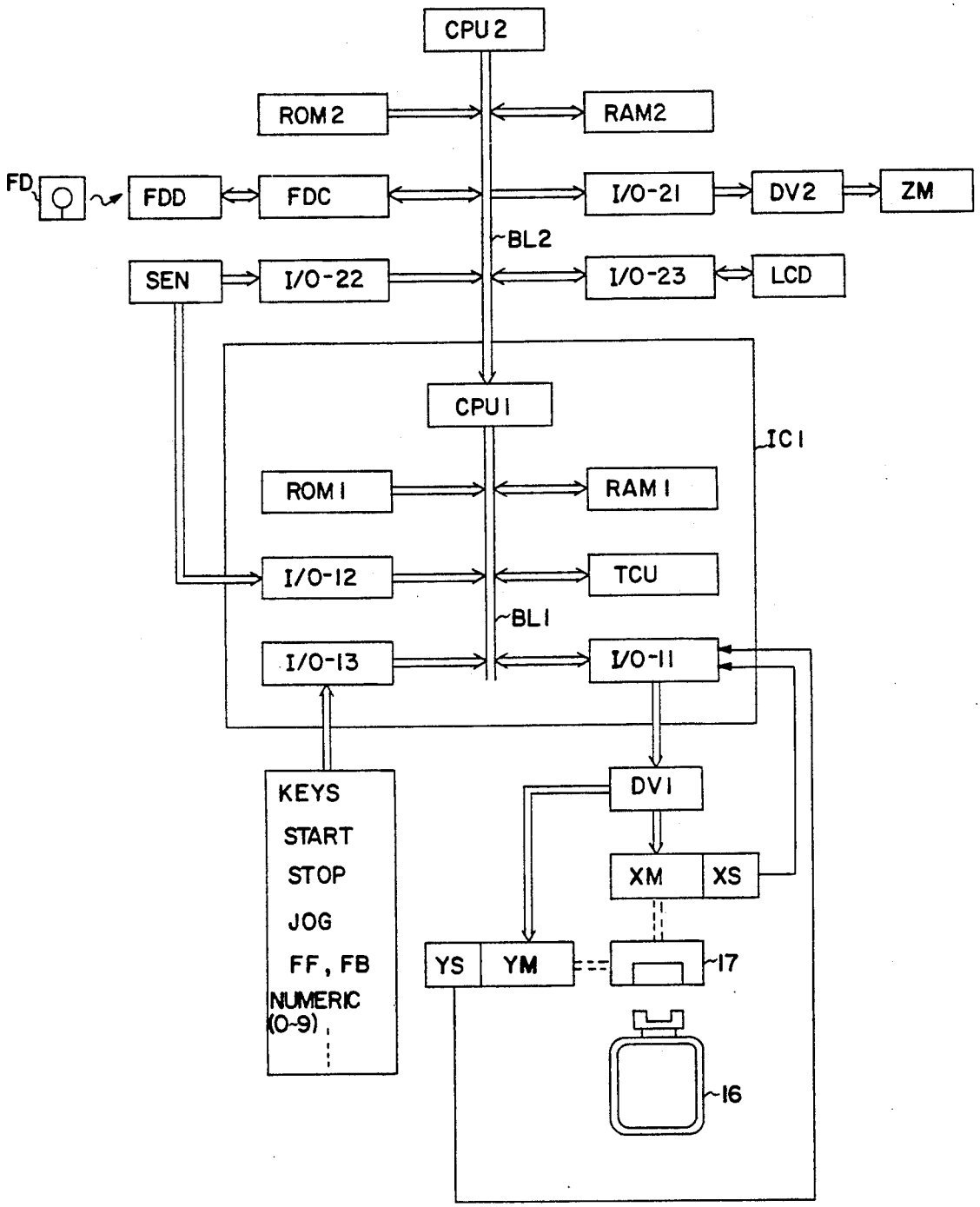
FIG. 13 is a block diagram of the control system.

An overall system arrangement is diagrammatically illustrated in FIG. 13. A central-processing-unit CPU2 (hereinunder called "master CPU") will operate in response to programs stored in a read-only-memory ROM 2 to conduct various kinds of control operation including reading-out of the embroidery pattern data, control of motors and key processings. There is also provided a random-access-memory RAM2 for temporarily storing flags and the embroidery control data.

Another central-processing unit CPU1 will act as a slave CPU and transmit key data to the master CPU. The key data will be inputted by depression of various keys including the followings: the start key START for starting the embroidering operation; the stop key STOP for suspending the embroidering operation; the frame shift keys JOG for shifting the embroidery frame 16 to designate a desired location at which a selected embroidery pattern should be produced on the fabric; a frame-back key FB for returning the embroidery frame 16 to a certain position for the purpose of reparing the embroidery pattern being formed in the frame back operation; a frame-forward key FF to be manipulated in the frame forward operation succeeding the frame back operation, and numeral ten-keys NUMERIC for selecting a desired on of the embroidery patterns to be produced on the fabric.

The key data transmitted from the slave CPU is processed in the master CPU to provide stitch point control data, which will then be supplied back to the slave CPU for controlling the driving condition of the pulse motors XM, YM, in response to programs stored in a read-only-memory ROM1. More particularly, the pulse motors XM and YM, accompanied by initial position sensors XS and YS respectively, are driven by a drive circuit DV1 which is, in turn, driven under control by the slave CPU via an input/output port I/0-11. Flags necessary for the drive control and the stitch point control data will be temporarily stored in a random-access-memory RAM1.

A timer/counter unit TCU will generate an interrupt signal after a programmed time and output a signal of a predetermined pulse width to various parts. The slave CPU, ROM1, RAM1 and the timer/counter unit TCU, as well as input/output ports I/0-11, I/0-12 and I/0-13 and an internal bus line BL1 are integrally constructed as a one-chip microcomputer IC1. The slave CPU is connected to the master CPU via another bus line BL2 and therefore may act as a kind of an input/output port.

The embroidery pattern data is stored in a floppy disc FD. When the floppy disc FD is loaded into the floppy disc drive FDD, the master CPU will control a floppy disc controller FDC so that the floppy disc drive FDD selectively reads the embroidery pattern data. The embroidery pattern data thus read out from the floppy disc FD will be supplied via the bus line BL2 to the RAM 2 to be temporarily stored therein. The selected embroidery pattern is represented on LCD.

A phase sensor SEN is connected to the upper drive shaft of the embroidering machine 10 for substantially continuously detecting rotational phases of the upper drive shaft, thereby generating various timing signals so that the embroidering operation may be controlled in synchronism with rotation of the upper drive shaft. The timing signals generated from the phase sensor SEN includes the followings: a XYACTPH signal outputted during a particular range of the rotational phase in which the embroidery frame 16 may be shifted in a particular case; a SAFEPH signal outputted during another phase range capable of shifting the embroidery frame in another particular case; a STOPPH signal outputted for stopping the needle 13 at a predetermined upper point during its vertical path of reciprocation; a VELO signal required for detecting a speed of rotation of the upper drive shaft for feedback control operation of the machine motor ZM. These signals will be described hereinlater in more detail.

Figure 14:
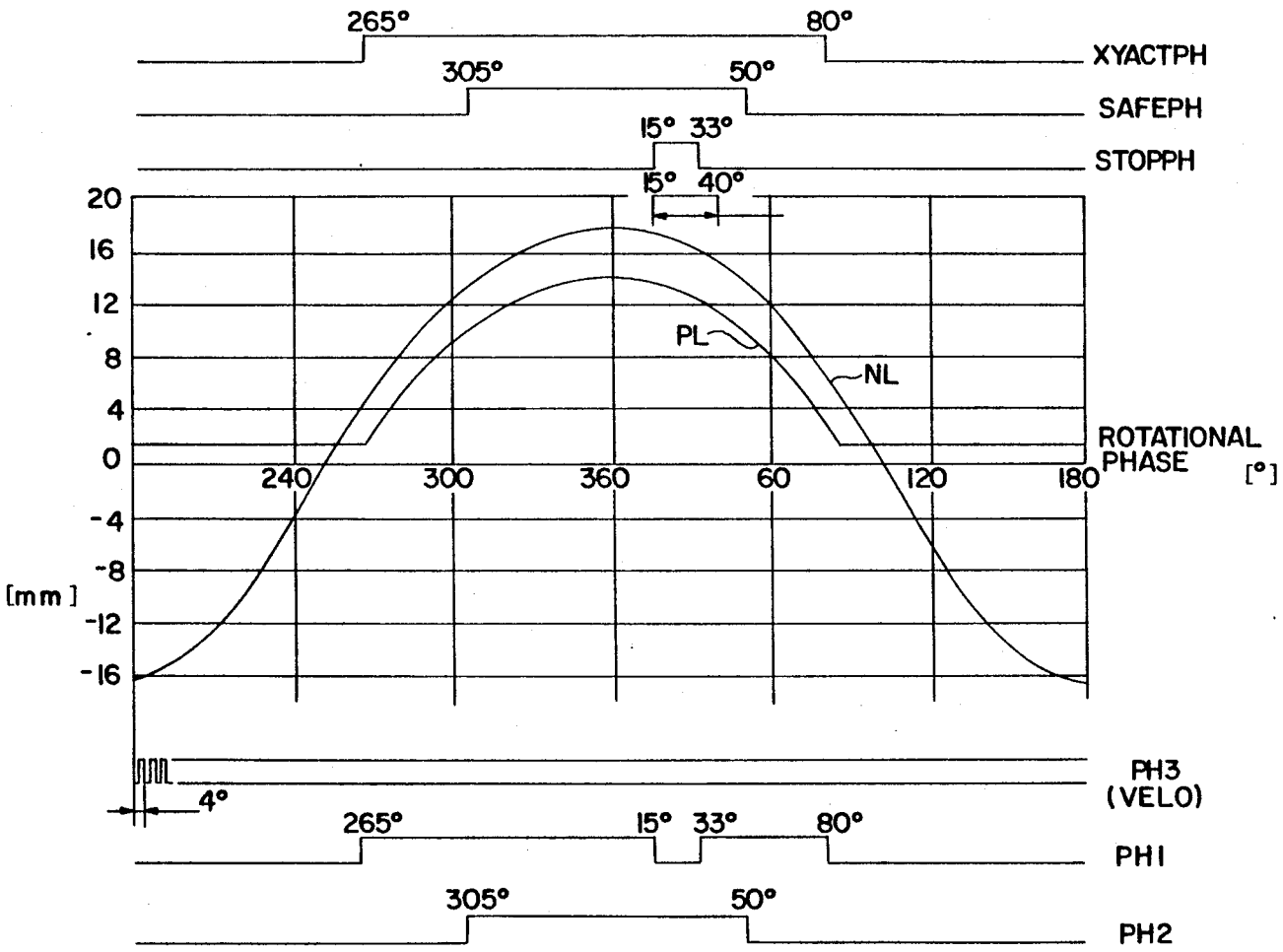
FIG. 14 is a graph showing positions of a needle tip end and a pressure foot in relation to a rotational phase of an upper drive shaft of the embroidering machine, as well as various signal outputted in specific ranges of the rotational phase of the upper drive shaft.

Correlation between the rotational phases of the main drive shaft detected by the sensor SEN and the abovedescribed timing signals are diagrammatically shown in FIG. 14, which also shows a distance PL between the presser foot 15 and the needle plate 18 and another distance NL between the tip end of the needle 13 and the needle plate which are varied with rotation of the main drive shaft. The rotational phase of the main drive shaft will be determined to be 0° when the needle is in its upper dead point.

XYACTPH signal is outputted while the needle tip end is separated above the fabric stretched within the embroidery frame 16, which is between 265° and 80° of the rotational phase of the main drive shaft. SAFEPH signal is outputted while the bottom of the presser foot 15 is located above a peripheral edge (which is in this example higher by about 9 mm than a level of the stretched fabric supported within the frame 16 and overlying the needle plate 18) of the embroidery frame 16, that is between 305° and 50° of the rotational phase. STOPPH signal is determined to have every rise at the rotational phase of 15° for stopping the needle at a predetermined position that should correspond in this example to the rotational phase range of 15°~40°. In this example STOPPH signal falls at about 33° phase but this has no particular meaning. VELO signal comprises alternate ON/OFF signals generated 90 times per rotation at every 4° phase.

Figure 15:
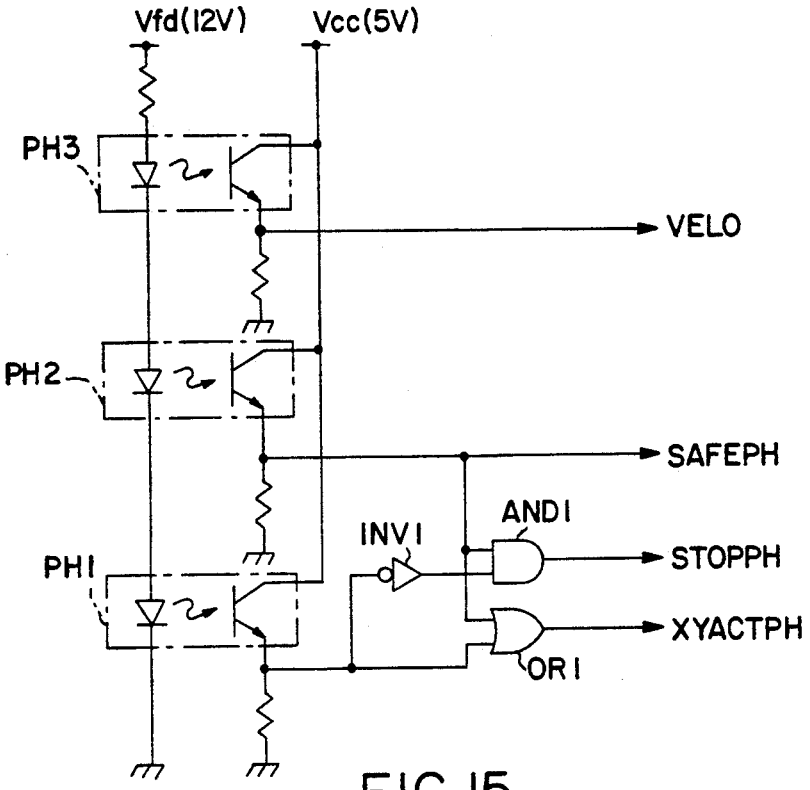
FIG. 15 is a circuit of a rotational phase sensor provided for the upper drive shaft.

The phase sensor SEN may have an electric circuit shown in FIG. 15. A series of photo-interrupters PH1, PH2 and PH3 are each constituted by a light-emitting-diode (LED) and a photo-transistor arranged in opposition to the LED with a slitted interrupter disc secured to the upper drive shaft being positioned therebetween. The output signals from the respective photo-interrupters PH1 to PH3 are shown in the lower part of FIG. 14. More particularly, the first photo-interrupter PH1 is designed such that the light from the LED is allowed to pass through the slit formed in the interrupter disc to be received by the photo-transistor in the rotational phase ranging from 265° to 15° and from 33° to 80°, during which the signal is being outputted from the photo-interrupter PH1. The second photo-interrupter PH2 will output the signal in the like manner but during the rotational phase range between 305° and 50°. The third photo-interrupter PH3 is designed to interrupt the light penetration in 2° rotation at every interval of 2° rotation which will be utilized as VELO signal. SAFE signal may be obtained merely by fetching the signal outputted from the second photo-interrupter PH2. The output signals from the first and second photo-interrupters PH1 and PH2 are inputted to an OR gate OR1 so that XYACTPH signal may be obtained as a logical sum of these two signals. The output signal from the second photo-interrupter PH2 and a signal inverted by an inverter INV1 from the output signal from the first photo-interrupter PH1 are inputted to an AND gate AND1 so that STOPPH signal may be obtained as a logical product of these two signals.

Figure 16:
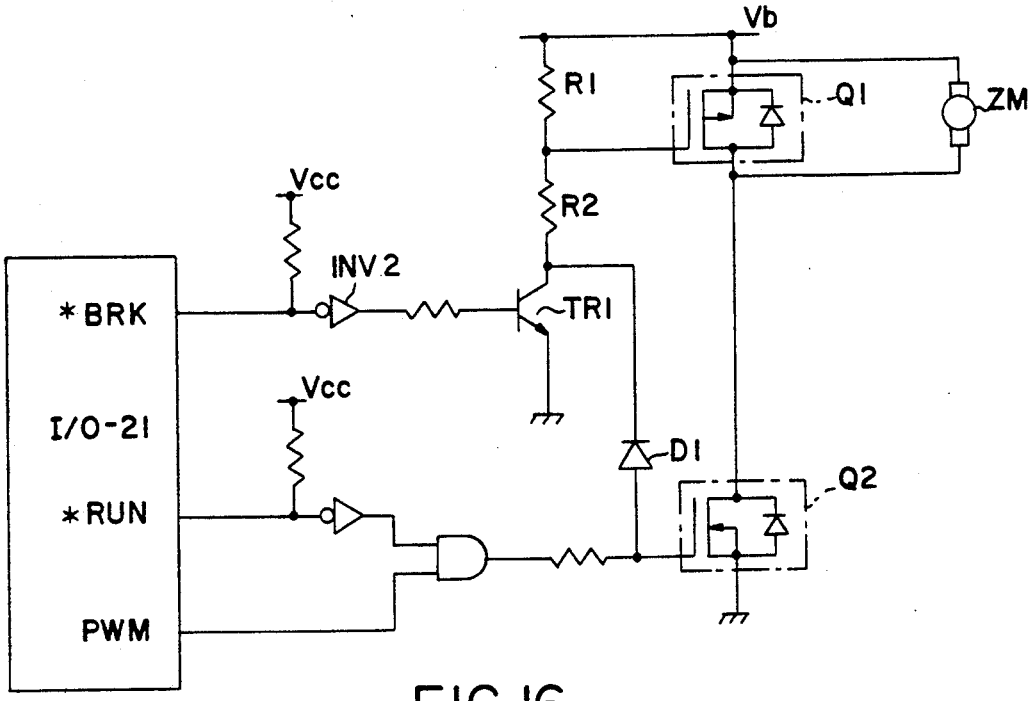
FIG. 16 is a circuit of a drive circuit for driving a machine motor employed to the upper drive shaft.

Referring again to the system block diagram of FIG. 13, the master CPU operates in response to the embroidery pattern data and the stitch control data to thereby control operation of a second drive circuit DV2 via an input/output terminal I/0-21. The drive circuit DV2, in turn, controls rotating and stopping conditions of the machine motor ZM. An example of the drive circuit DV2 is shown in FIG. 16.

The drive circuit DV2 is responsive to signal levels at output ports *BRK and *RUN and a pulse width control port PWM of the input/output terminal I/0-21. When the output port *BRK becomes at an L level, a gate of a P-MOS FET (Q1) becomes L via an inverter INV2 and a transistor TR1 to thereby apply the brakes to the motor ZM. With this breaking effect, the flywheel 19 (FIG. 12) will be prevented by being freely rotated by manual operation, especially in the course of the stitch area confirming operation. N-MOS FET (Q2) will control the driving condition of the machine motor ZM in a conventional manner. There is provided a diode D1 for prevention simultaneous working of Q1 and Q2 even should the master CPU run away so that both of the output ports *BRK and *RUN become L at the same time. Q1 and Q2 are both inoperative while the motor ZM is not driven under a normal condition.

When, during the stitch area confirming operation, the operator manually rotates the flywheel 19 so that the rotational phase of the upper drive shaft is now deviated from the SAFEPH signal outputting range (305°~50°), there will appear a quick suspension of the embroidery frame 16 which has been shifted by the pulse motors XM and YM in response to the pattern data for the stitch area confirmation purpose. In this case, the stitch area confirming operation is interrupted and the machine motor ZM is rotated to some degree until the upper drive shaft again enters the SAFEPH signal outputting range. After that, the pulse motors XM and YM should be re-started for the subsequent stitch area confirming operation.

Figure 17:
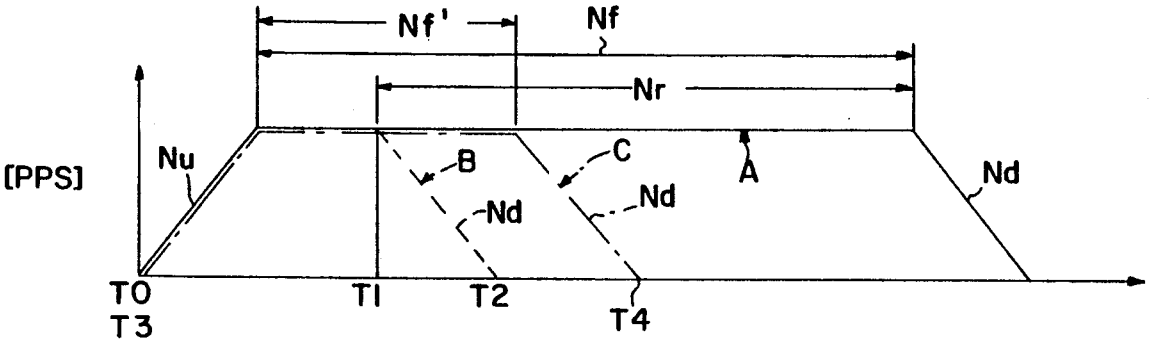
FIG. 17 is a diagram showing a manner of the pulse motor drive control operation especially when the pusle motor is accidently suspended in the course of the stitch area confirming operation.

More particularly, referring to FIG. 17, in normal operation, the pulse motor starts driving at a time TO and its speed defined in unit of PPS (pulse per second) is increased up to a predetermined maximum speed during a first predetermined step number Nu in a rising part. When the maximum speed is gained, the said speed is maintained for a second predetermined step number Nf in a constant drive part, which is followed by a falling part during which the speed is reduced from the maximum one to zero in a third predetermined step number Nd. There is a predetermined total step number N, that is a total sum of the first to third predetermined step numbers Nu, Nf and Nd. Thus, the speed of the pulse motor is varied as shown by a curve A under a normally controlled condition.

It is now supposed that after the pulse motor has started driving at a time TO, the operator manually rotates the flywheel 19 to advance the rotational phase of the main drive shaft so that at a time T1 the rotational phase enters a shift-prohibited range (50° to 305°) in which the embroidery frame can not be shifted due to contact between the peripheral edge thereof and the needle and/or the presser foot. In such an accidental case, the pulse motor is controlled to decelerate as shown by a plotted curve B. After the pulse motor is stopped at a time T2, the machine motor ZM is driven so that the main drive shaft again enters into a frame shiftable range of (305° to 50°) at a time T3, at which the pulse motor will again start to drive. The remaining step number Nr is divided into the first to third step numbers Nu, Nf' and Nd, in response to which the pulse motor is driven and terminated at a time T4, as shown by an imaginary curve C. The total step numbers in the curves B and C will be identical to the predetermined total step number N in the normal curve A. Thus, the prescribed stitch area confirming operation may be completed even when the frame shift is accidentally discontinued.

Figure 1:
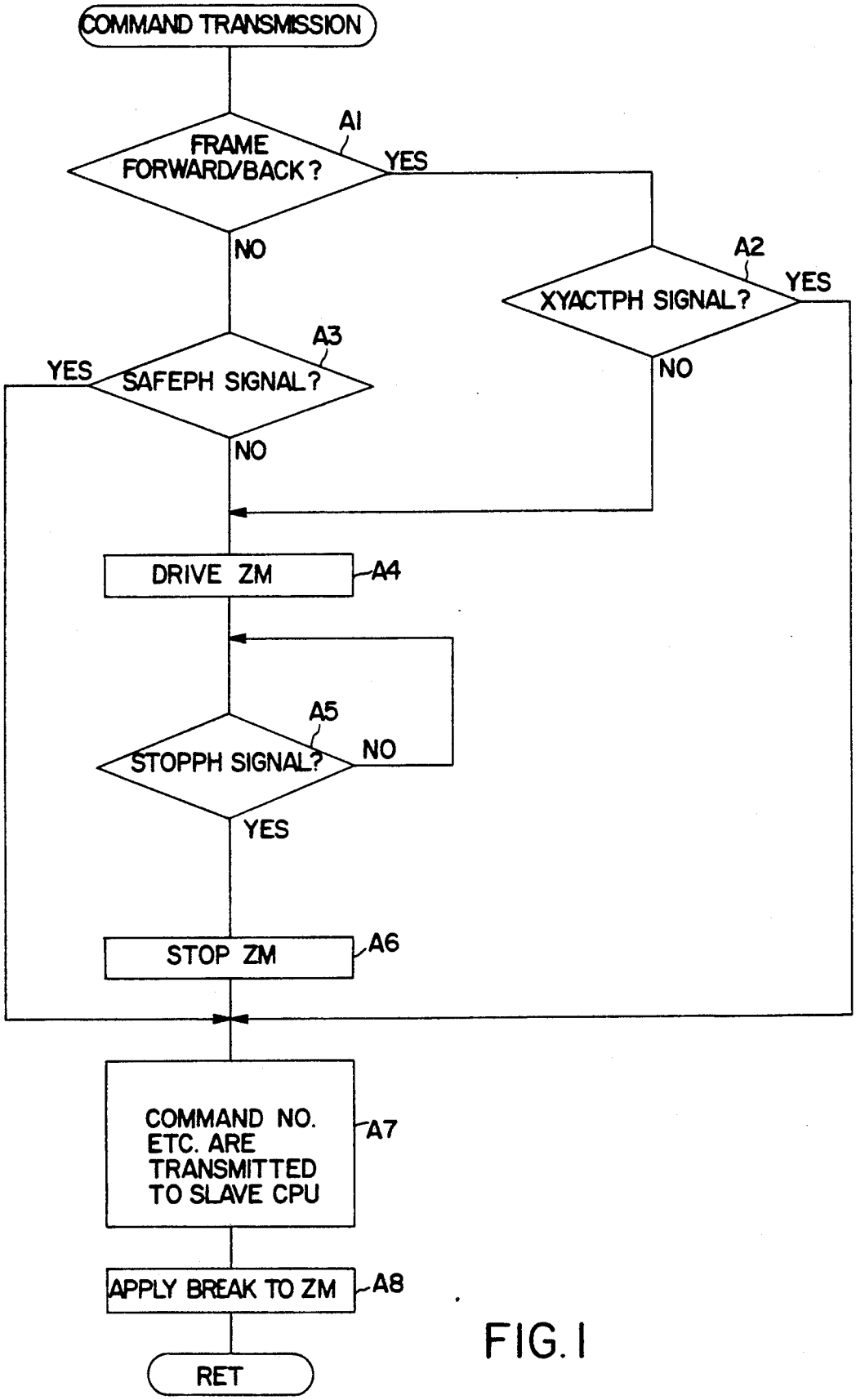
FIG. 1 is a flow chart of a program for transmission of any command from a master CPU to a slave CPU.

Programs for controlling the frame shift operation, including the manual shift operation, the stitch area confirming operation and the frame forward/back operation, are stored in ROM1 and ROM2. First, control operation for the command transmission from the master CPU to the slave CPU will be processed as shown in a flow chart of FIG. 1. When any kind of commands for the frame shift operation is transmitted from the master CPU, it is discriminated in a first step A1 if the frame shift thus commanded is for the frame forward/back operation for the purpose of repairing an incomplete stitch portion which has been previously produced on the fabric. If so, the procedure goes to a step A2 in which it is discriminated if the current rotational phase of the upper drive shaft is in a particular range (265° to 80°) in which XYACTPH signal is outputted, which means that the needle 13 is positioned above the fabric in no contact thereto. If the command designates the frame shift in the stitch area confirming operation, the result of discrimination at step A2 is NO and then it is discriminated in a step A3 if the current rotational phase of the upper drive shaft is in a range of 305° to 50° capable of generating SAFEPH signal, meaning that the needle 13 and the presser foot 15 are positioned sufficiently above the peripheral upstanding edge of the embroidery frame 16.

If the result of discrimination at step A2 or A3 is such that the frame can not be shifted in the current circumstances, the machine motor ZM is rotated to drive the upper drive shaft in a step A4 until the rotational phase becomes 15° at which STOPPH signal is outputted. In immediate response to the rise of STOPH signal occuring at the rotational phase of 15°, which is confirmed in a step A5, the upper drive shaft is stopped in a step A6, resulting in that the needle 13 is now positioned correspondingly to the rotational phase ranging from 15° to 40°. It is noted in this connection that at the rise of STOPPH signal the P-MOS FET (Q1) is turned OFF and the N-MOS FET (Q2) is ON so that the machine motor ZM is applied the brakes, so that the needle may be kept standstill at an upper position far from the fabric until a substantial force is applied to the flywheel 19 by the operator.

Next in a step A7, the master CPU transmits to the slave CPU via the bus line BL2 a command number representing a type of the frame shift operation and data regarding an amount (a step number) and a direction of shifting the embroidery frame. The master CPU will control such that P-MOS FET (Q1) remains ON to maintain the braked condition of the machine motor ZM until the slave CPU has completed the commanded operation (step A8).

Figure 2:
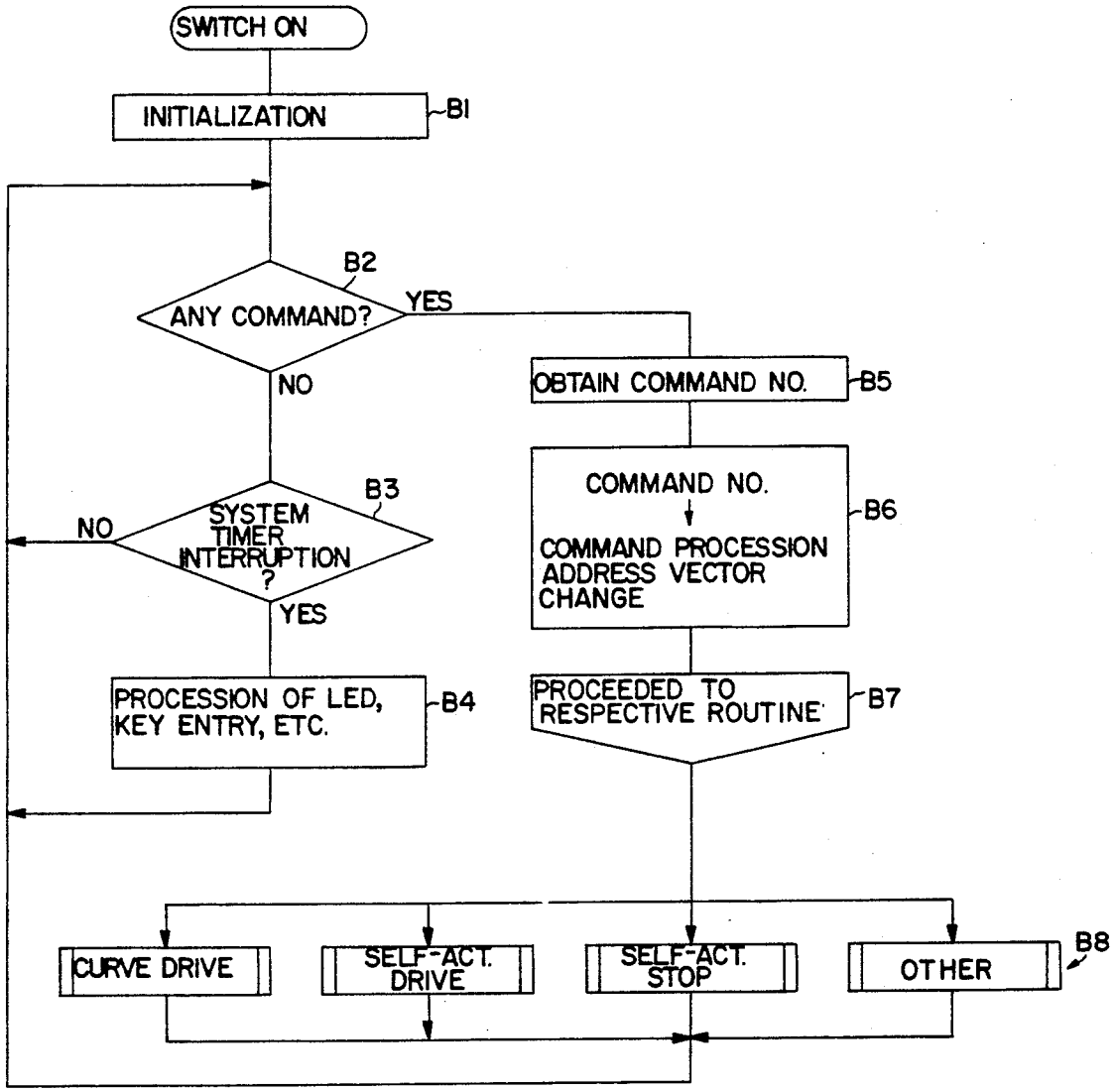
FIG. 2 is a flow chart of a main program for control of the embroidery frame shift operation.

A main program for control of the frame shift operation conducted by the slave CPU will now be described in reference to a flow chart of FIG. 2. First, various elements in the system including the input/output ports I/O-11 to -13 of the slave CPU and the timer/counter unit TCU are initialized in a step B1. It is then discriminated in a step B2 if any command is transmitted from the master CPU and writen in a register of the slave CPU. If there is no command written in the slave CPU, the procedure advances to a step B3 in which it is discriminated if there is an interrupt request signal which is supplied from the timer/counter unit TCU at a predetermined interval. If not, the procedure is returned to the step B2. In response to the interrput request signal, various control operation in connection with the switching on/off of LED in the photointerrupters PH1 to PH3, reading-out of the key inputs, etc are processed in a step B4, then returning to the step B2.

If there is some command written in the slave CPU which is discriminated in the step B2, the corresponding command number is obtained in a step B5. Then in a step B6, a head address of a program for processing the operation identified by the command number given in the step B5 is determined in accordance with a program address list stored in ROM1, and the program counter of the slave CPU is set to the head address thus determined. A routine of the program designated by the head address is exercised in steps B7 and B8, then returning to the step B2.

Control for the manual shift operation, which is required for locating as desired the embroidery frame 16 relative to the needle 13 before commencing the embroidering operation, will be processed in the following manner. This control is carried out in accordance with a self-activation drive command, rotation-direction data and a self-activation stop command.

Figure 3:
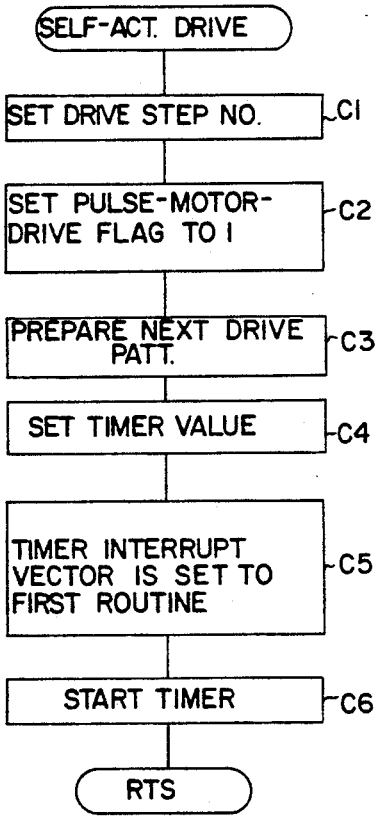
FIG. 3 through FIG. 6 are flow charts showing control procedure during the manual shift operation.

More particularly, in response to manipulation of some of the frame shift keys JOG, the self-activation drive command is transmitted from the master CPU to the slave CPU. A self-activation drive routine carried out responsive to the self-activation drive command will be described in reference to the flow chart of FIG. 3. A step number for driving the pulse motor is determined to be one greater than the maximum step number capable of shifting the embroidery frame, in a step C1. A flag representing the pulse motor being under driving is set to 1 in a step C2. In response to the rotation-direction data supplied from the master CPU, a drive pattern for driving the pulse motor for the next operation is determined in a step C3. A specific timer value corresponding to the self-activation drive PPS is set to the timer/counter unit TCU in a step C4. A timer interruption vector in the overflow of the timer/counter unit TCU is set to a head address of a first self-activation timer interruption routine in a step C5, and then in a step C6 the timer/counter unit TCU is caused to start counting.

Figure 5:
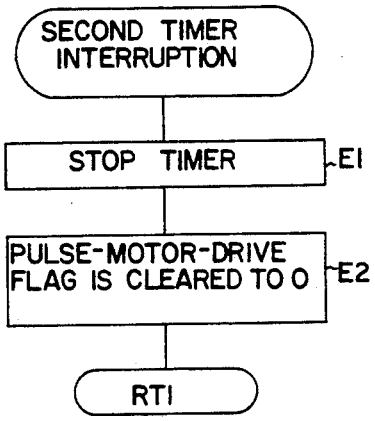
Figure 4:
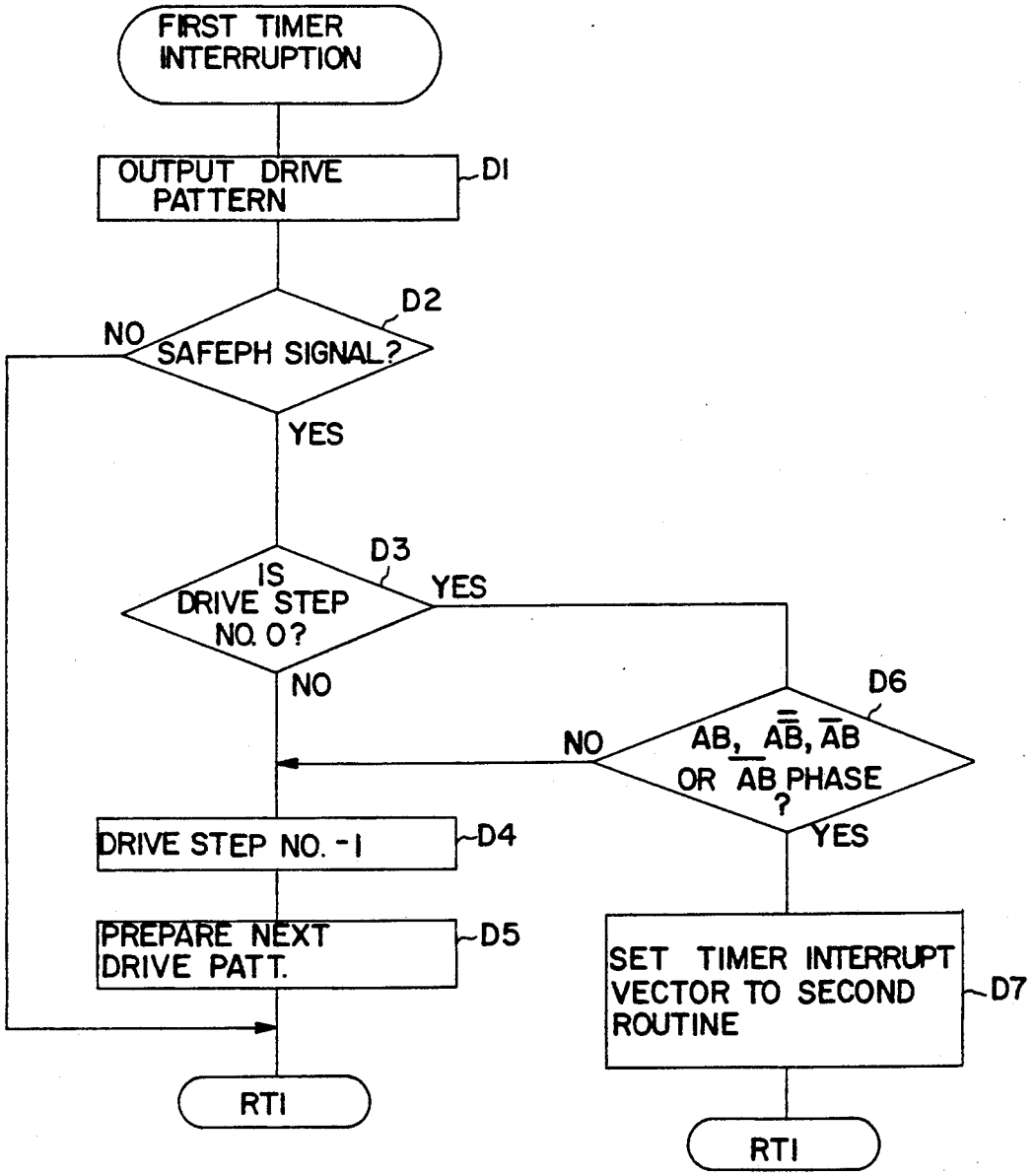

The first self-activation timer interruption routine will now be described while referring specifically to the flow chart of FIG. 4. The next drive pattern prepared in the step C3 in the self-activation drive routine or in a later step D5 in this routine is, in a step D1, outputted to the pulse motor via the input/output port I/O-11 and the pulse motor driving circuit DV1 so that the pulse motor is driven by one step. It is discriminated in a step D2 if the upper drive shaft has a rotational phase within the SAFEPH signal outputting range (305° to 50°) meaning that the embroidery frame 16 may be shifted without any contact to the needle 13 and the presser foot 15. If it is so discriminated, the procedure advances to the next step D3 in which it is discriminated if the drive step number is zero. In a step D6, it is discriminated if the drive pattern designates a two-phase drive which means that the pulse motor is driven by two phases among A, B, $\overline{A}$ and $\overline{B}$ phases. This will enable that the pulse motor is always stopped in the two-phase position. If the drive step number is not zero and/or the drive pattern does not comprise the two-phase drive, the drive step number is decreased by one in a step D4, and the next drive pattern is prepared in a step D5 followed by returning to the main program. If the drive step number is zero and the drive pattern comprises the two-phase drive which are discriminated in the steps D3 and D6 respectively, the timer interruption vector in the overflow of the timer/counter unit TCU is set to a head address of a second self-activation timer interruption routine which is described below in reference to the flow chart of FIG. 5.

More particularly, operation of the timer/counter unit TCU is suspended in a step E1 so that further timer interruption is prevented until the timer/counter unit TCU is re-started. Next in a step E2, the flag which has been set to 1 in the step C2 in the self-activation drive routine is cleared to 0.

Figure 6:
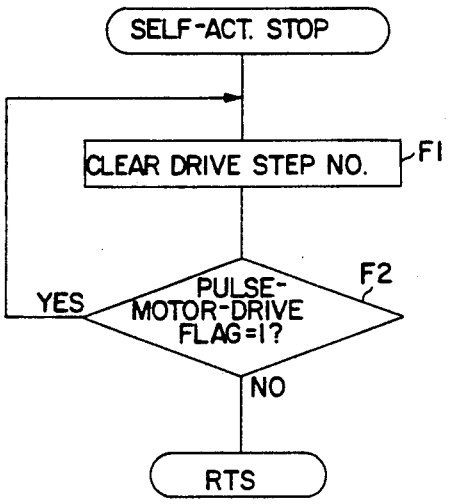
Figure 7:
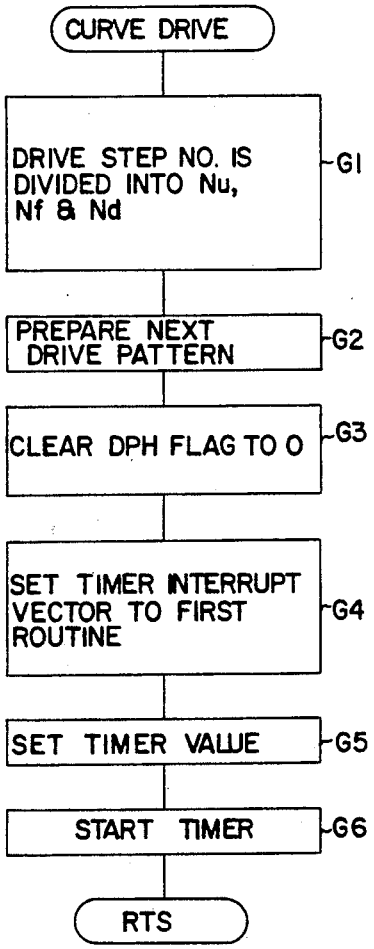
FIG. 7 is a flow chart of a curve drive processing routine carried out in the stitch area confirming operation.

A self-activation stop routine in the manual shift operation will be proceeded as shown by the flow chart of FIG. 6. When the operator discontinues manipulation of JOG keys, the self-activation stop command is transmitted from the master CPU to the slave CPU, in response to which this routine will commence. First, the drive step number is cleared to zero in a step F1. This step is repeated until the flag representing the pulse motor being under driving becomes 0, that is, when the second self-activation timer interruption routine has been carried out so that the pulse motor is stopped at the two-phase position, which is discriminated in a step F2.

It will be understood from the foregoing that if it is found that the position of the upper drive shaft is deviated from the SAFEPH signal outputting range during the manual shift operation, the proceeding in the step D2 controls such that the same drive pattern is repeatedly outputted at every self-activation PPS time, thereby resulting in an immediate stopping of the pulse motor.

Control procedure for stitch area confirming operation which is carried out before starting the actual embroidering operation, for the purpose of confirming that the selected embroidery pattern may surely be produced on the fabric supported within the embroidery frame. For commencing this control operation, a curve drive command, a step number for shifting the embroidery frame and rotation-direction data of the selected embroidery pattern are determined by the master CPU in accordance with the stitch point control data which is in turn determined based on the embroidery pattern data thereof, and then supplied to the slave CPU.

As having been described in reference to FIG. 17, the drive step number is divided into a first step number Nu in the rising part, a second step number Nf in the constant drive part and a third step number Nd in the falling part, which is processed in a step G1. The next drive pattern is prepared based on the rotation-direction data in a step G2. A flag DPH representing that the upper drive shaft enters into a shift-prohibited range of the rotational phase is cleared to 0 in a step G3. A timer interruption vector is set to a head address of a first curve drive timer interruption routine in a step G4. A timer value corresponding to the self-activation PPS is set to the timer/counter unit TCU in a step G5, and in a succeeding step G6 the timer/counter unit TCU starts counting.

Figure 8:
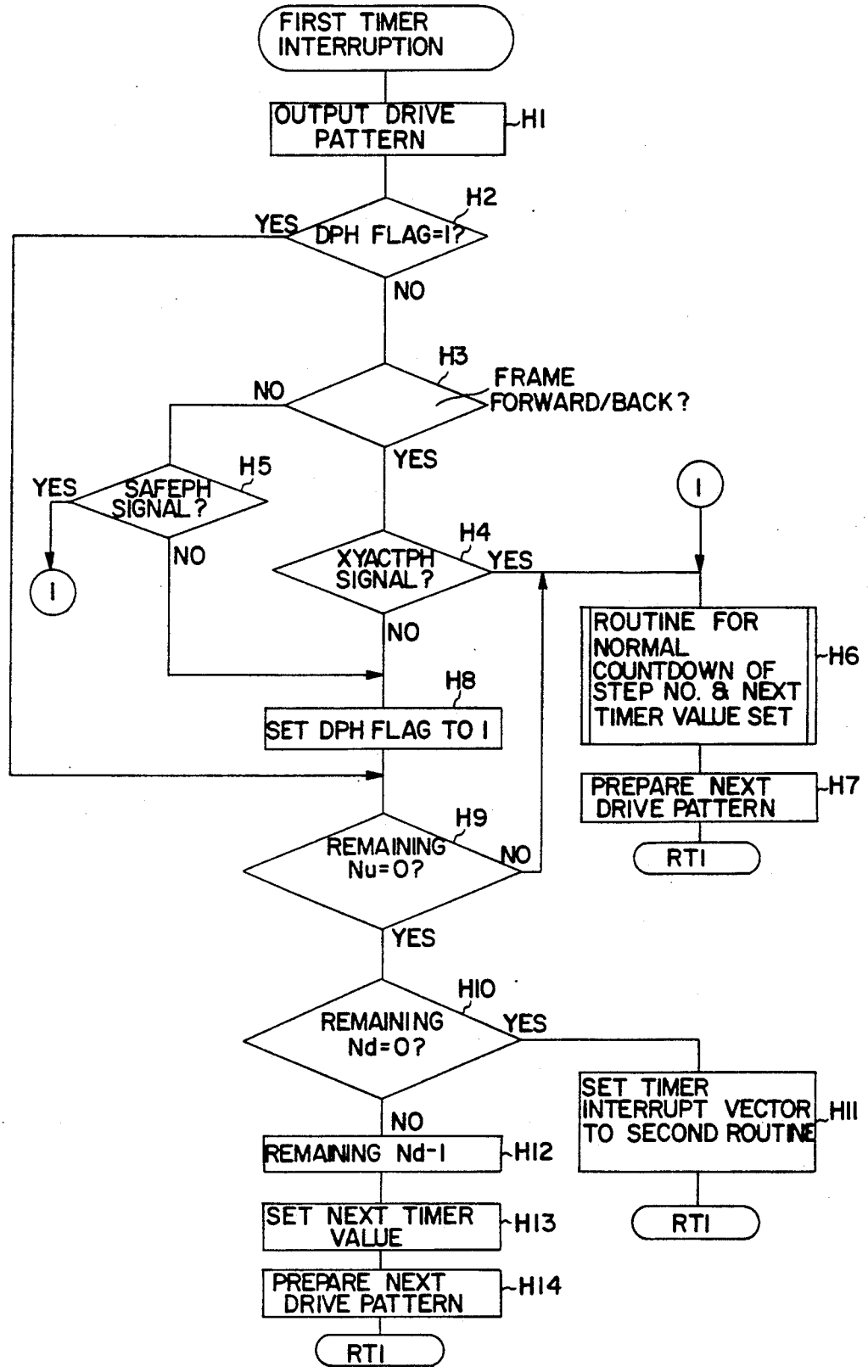
FIG. 8 is a flow chart of a first curve drive timer interruption routine.

The first curve drive timer interruption routine is shown in the flow chart of FIG. 8. In a first step H1, the drive pattern which has been determined is now outputted to the input/output terminal I/O-11 so that the pulse motor is driven by one step. It is then discriminated in a step H2 if DPH flag is set to 1. Steps H3, H4 and H5 are provided for discriminating if the current position or rotational phase of the upper drive shaft will allow the embroidery frame to be shifted in the operation being now processed. In the stitch area confirming operation, it is discriminated if the upper drive shaft is positioned in the SAFEPH signal outputting phase (305° to 50°). If the embroidery frame is shiftable, the process advances to a succeeding step H6 in which a normal process routine is carried out in such manner as described later in reference to the flow chart of FIG. 9. After completing the normal process, another drive pattern to be outputted in the next interruption is provided in a step H7.

When the embroidery frame is not shiftable in view of the current rotational phase of the upper drive shaft, the process goes to a step H8 in which DPH flag is set to 1. In this case, it is then discriminated in a step H9 if the remaining step number in the rising part is zero which means that the pulse motor speed has already reached the maximum one and is residing in the constant drive part. If not, the process is returned to the step H6 for conducting the normal process routine and the pulse motor is accelerated.

Figure 11:
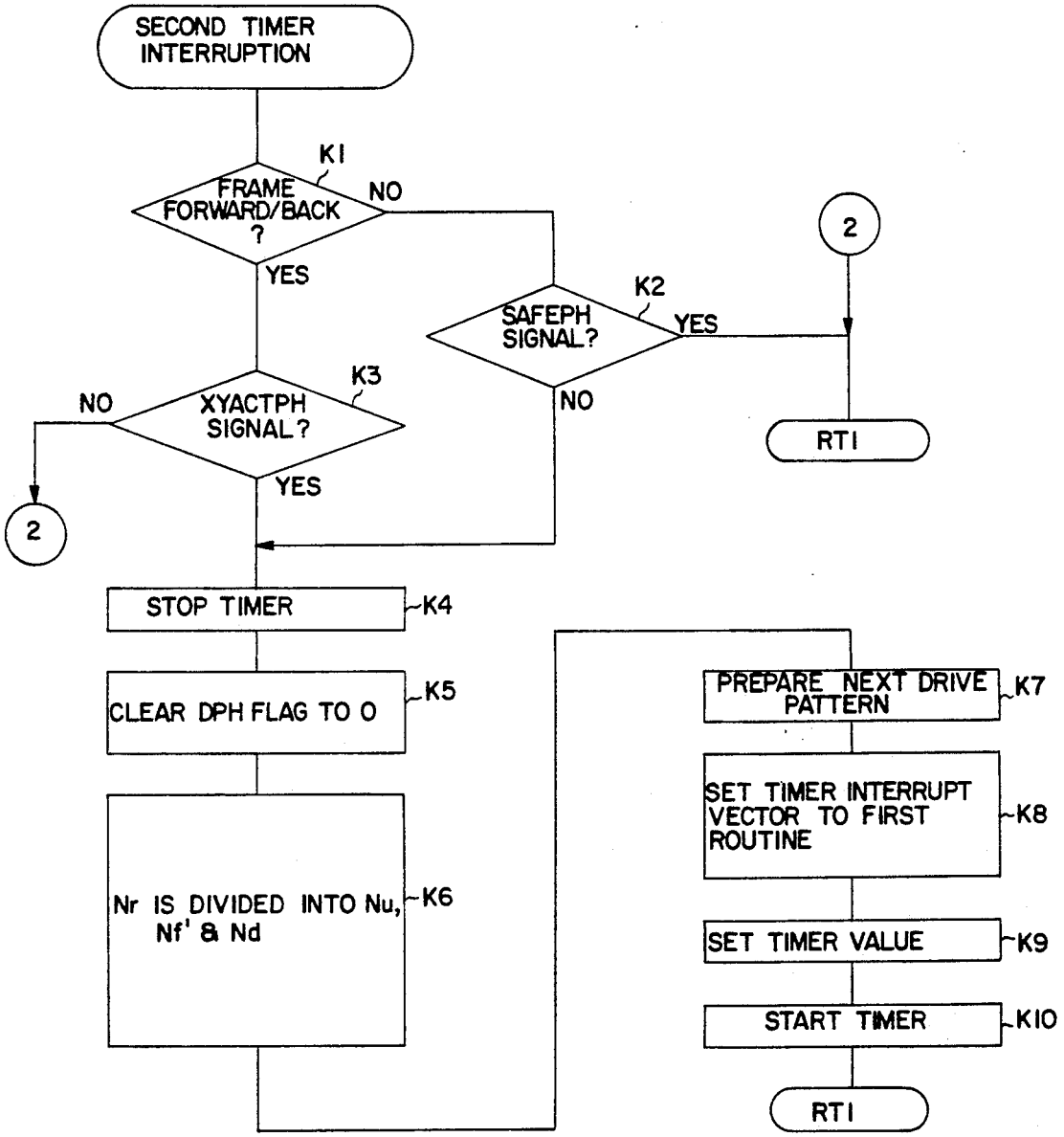
FIG. 11 is second curve drive timer interruption routine.

Next in a step H10, it is discriminated if the third step number Nd in the falling part is zero, in which case the timer interruption vector is set to a head address of a second curve drive timer interruption routine which is shown in FIG. 11. If not, the step number Nd is reduced by one in a step H12, and next in a step H13 the next timer value corresponding to the reduced step number obtained in the step H12 is determined in reference to a curve table stored in ROM1 and written in the timer/counter unit TCU. The next drive pattern is determined in accordance with the rotation-direction data in a step H14.

Figures 9, 10:
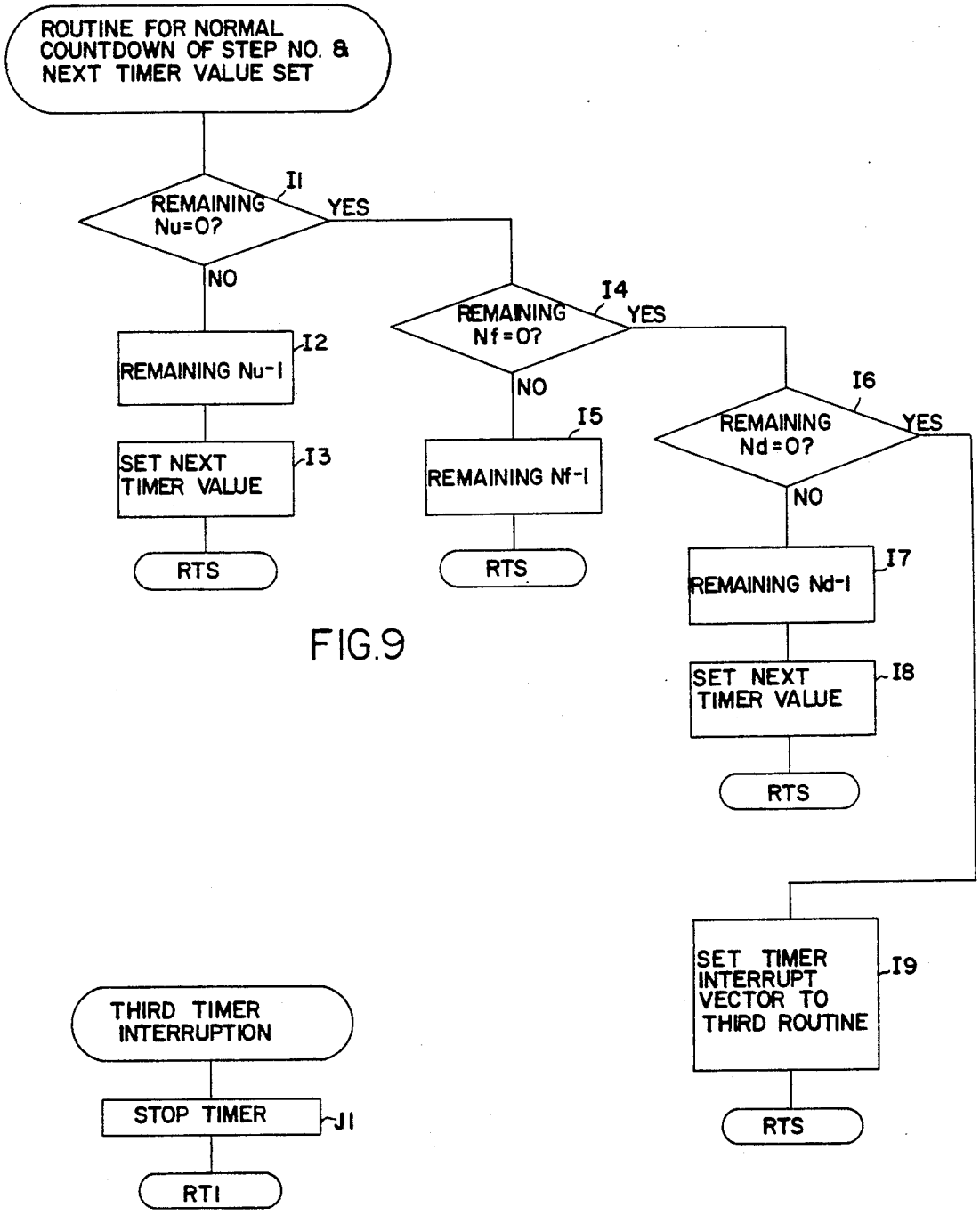
FIG. 9 is a flow chart of a routine for count-down of a step number and determination of a next timer value.
FIG. 10 is a flow chart of a third curve drive timer interruption routine.

The normal process routine carried out in the step H6 will now be described in detail in reference to the flow chart of FIG. 9. In a step I1 it is discriminated if the first step number Nu in the rising part is 0 and if not, the first step number Nu is reduced by one in a step I2 and then the next timer value is determined to correspond to the reduced step number in a step I3. If the first step number Nu is zero, then it is discriminated in a step I4 if the second step number Nf in the constant drive part is zero. If not, the second step number Nf is reduced by one in a step I5. If it is discriminated that the first and second step number Nu and Nf are both zero, it is then discriminated in a step I6 if the third step number Nd is zero. If not, the third step number Nd is reduced by one in a step I7 and the corresponding timer value is determined for the next operation in a step I8. If all of the first to third step numbers Nu, Nf and Nd are zero which means that the pulse motor has been driven completely in the predetermined total step number N which is a total sum of the first to third step numbers Nu, Nf and Nd, the process goes to a step I9 in which the timer interruption vector is set to a top address of a third curve drive timer interruption routine shown in FIG. 10.

The third curve drive timer interruption routine comprises a step J1 in which the timer operation is now terminated and the master CPU is informed that the pulse motor driving operation has been completed.

The second curve drive timer interruption routine is shown in FIG. 11 and carried out when there is a timer interruption after the proceeding in the step H11 in the first curve drive timer interruption routine has been completed. In the example shown in FIG. 17, this routine is carried out at a time after T2. In steps K1 to K3 it is discriminated if the embroidery frame is shiftable in the stitch area confirmation operation (K2) or the frame back/forward operation (K3). If not, the process awaits the next timer interruption occuring after elapse of a predetermined period of time corresponding to the self-activation PPS.

When the embroidery frame is found shiftable, the timer is stopped for the time being in a step K4 and DPH flag is cleared to 0 in a step K5. Then in a step K6, the remaining step number Nr is divided into a first step number Nu in the rising part, a second step number Nf' in the constant drive part and a third step number Nd in the falling part. The next drive pattern is prepared in a step K7. The timer interruption vector is changed to a head address of the first curve drive timer interruption routine in a step K8. A period of time corresponding to the self-activation PPS is set to the timer in a step K9. Finally in a step K10 the timer is re-started.

In accordance with the control system of the present invention, there are provided two different ranges of the rotational phase of the upper drive shaft, which are selectively applied for control of the frame shift operation now being processed. It is the first range that outputs XYACTPH signal, when the needle is positioned above the fabric, which is suitable to the frame forward-/back operation. The initial position determining operation, the manual shift operation and the stitch area confirming operation will be carried out only when the needle and the presser foot are positioned above the upstanding peripheral edge of the embroidery frame, which is detected in response to SAFEPH signal outputted when the upper drive shaft is in the second range of the rotational phase. XYACTPH signal and SAFEPH signal may be easily obtained by a simple combination of two phase detection signals PH1 and PH2.

Moreover, when the operator manually rotates the flywheel to obtain a closer position of the needle relative to the fabric in the stitch area confirming operation, the pulse motor is subjected to a sudden stop before the needle penetrates the fabric. Since the machine motor is continuously given the breaking effect during the frame shift operation, overrotation of the flywheel will be effectively prevented.

Although the invention has been described in conjunction with a specific embodiment thereof, it is to be understood that many variations and modifications may be made without departing from spirit and scope of the invention as defined in the appended claims.

What is claimed is:

1. In an electronically controlled embroidering machine having an upper drive shaft rotatably driven by a machine motor, a needle bar connected to the upper drive shaft and driven therewith to reciprocate in a vertical direction, a needle secured to a lower end of the needle bar, a loop-taker means cooperating with the needle to catch a thread loop formed around the needle to thereby form a stitch, an embroidery frame for supporting a fabric, pulse motor means for shifting the embroidery frame in a horizontal plane to thereby vary relative position between the needle and fabric supported within the embroidery frame, a presser foot vertically reciprocated in synchronism with reciprocation of the needle to exert a downward pressure onto the fabric, and memory means for storing pattern data for a plurality of embroidery patterns, pulse motor means being driven under control in response to the pattern data of a selected one of the embroidery patterns to produce the selected embroidery pattern on the fabric, a control system for controlling horizontal shift of the embroidery frame which comprises:

phase detecting means for detecting rotational phase of the upper drive shaft;

drive setting means for setting numbers of steps and a rotational direction of the pulse motor means, said numbers of steps and said rotational direction of the pulse motor means determining the horizontal shift of the embroidery frame without rotation of the upper drive shaft;

discriminating means for discriminating whether the embroidery frame may be shifted or not in response to a detection result from said phase detecting means, said discriminating means discriminating a first condition during which the embroidery frame may be shifted because the upper drive shaft is at standstill and is positioned within a specific phase range in which the needle is positioned sufficiently above the fabric and a second condition during which the embroidery frame may not be shifted because the upper drive shaft is out of said specific phase range so that the needle is penetrating the fabric or positioned substantially in a close vicinity to the fabric;

drive control means operated when said discriminating means discriminates said first condition to steppingly rotate the pulse motor means with said numbers of steps and said rotational direction determined by said drive setting means, while the upper drive shaft is kept at standstill; and stop means operated when said discriminating means discriminates said second condition to immediately stop the pulse motor means.

2. The control system as defined in claim 1 wherein said discriminating means comprises a first means for discriminating if the rotational phase of the upper drive shaft is in a first specific range in which the needle is positioned above the fabric and a second means for discriminating if the rotational phase of the upper drive shaft is in a second specific range in which the needle and the presser foot are positioned above an upstanding peripheral edge of the embroidery frame.

3. The control system as defined in claim 1 wherein said drive control means includes a brake means for continuously applying a brake to the machine motor while the pulse motor means is being steppingly rotated.

4. The control system as defined in claim 1 which further comprises re-starting means for re-starting the pulse motor means after the embroidery frame has been stopped by said stop means and when the upper drive shaft has rotated to be within said specific phase range.

* * * * *

UNITED STATES PATENT AND TRADEMARK OFFICE
CERTIFICATE OF CORRECTION

PATENT NO. : 5,074,229

DATED : December 24, 1991

INVENTOR(S) : Hidenori Sasako, Michio Hisatake and Takeshi Kongo

It is certified that error appears in the above-identified patent and that said Letters Patent is hereby corrected as shown below:

Column 1, line 13, "aboveidentified" should read --above-identified--;
line 52, after "frame." start a new paragraph;
line 68, after "sensor" insert --means--.
Column 3, line 17, "pressure" should read --presser--;
line 26, "pusle" should read --pulse--.
Column 4, line 33, "on" should read --one--.
Column 6, line 28, "prevention" should read --preventing--.

Signed and Sealed this
Twenty-second Day of June, 1993

*Attest:*

*Attesting Officer*

Michael K. Kirk

MICHAEL K. KIRK

*Acting Commissioner of Patents and Trademarks*